United States Patent [19]

Deguchi

[11] 4,045,254

[45] Aug. 30, 1977

[54] METHOD FOR TOUGHENING TREATMENT OF METALLIC MATERIAL

[75] Inventor: Akio Deguchi, Yokohama, Japan

[73] Assignee: Mitsubishi Jukogyo Kabushiki Kaisha, Tokyo, Japan

[21] Appl. No.: 537,393

[22] Filed: Dec. 30, 1974

[51] Int. Cl.[2] ..... C21D 7/14

[52] U.S. Cl. ..... 148/12 R; 148/12 C; 148/12 E; 148/12 EA; 148/131

[58] Field of Search ..... 148/4, 12, 12.4, 131, 148/12 R

[56] References Cited

U.S. PATENT DOCUMENTS

| | | | |
|---|---|---|---|
| 1,946,545 | 2/1934 | Pessel | 148/131 |
| 3,337,376 | 8/1967 | Grange | 148/36 X |
| 3,438,822 | 4/1969 | Allen | 148/36 X |
| 3,748,197 | 7/1973 | Willson et al. | 148/131 |
| 3,857,741 | 12/1974 | Hultgren et al. | 148/37 |
| 3,951,697 | 4/1976 | Sherby et al. | 148/12 R |
| 3,986,898 | 10/1976 | Oshida | 148/13.2 |
| 3,998,665 | 12/1976 | Oshida | 148/12 R |

OTHER PUBLICATIONS

Metal Abstracts July-Dec. 1972 Abstract No. 31-1846.

*Primary Examiner*—W. Stallard
*Attorney, Agent, or Firm*—Cushman, Darby & Cushman

[57] ABSTRACT

A method for providing a toughening treatment for metallic material is herein described, which method is characterized in that the metallic material is subjected to a transformation super-plastic treatment by applying a mechanical load to said material while placing the same under a triangular-wave temperature cycle passing over a transformation point.

10 Claims, No Drawings

METHOD FOR TOUGHENING TREATMENT OF METALLIC MATERIAL

BACKGROUND OF THE INVENTION

The present invention relates to a method for providing a toughening treatment for metallic material by making use of transformation super-plastic phenomena.

Heretofore, heat treatment of metallic materials has been conducted in various ways for the purpose of enhancing the mechanical strength and improving toughness of metallic materials including steel. However, most of the methods were heat treatments at a raised temperature extending over a long period of time because they were aimed to disperse and separate non-metal interstitial substances such as carbides.

SUMMARY OF THE INVENTION

Therefore, it is an object of the present invention to provide a novel method for providing a toughening treatment for metallic materials that is based on a quite different principle from that in the prior art, and in which the treatment time is extremely short and wherein it is possible, compared with prior art methods to widely reduce the cost of treatment.

The inventor of the present invention was continuing experimental research on a transformation super-plasticity of soft steel, and during that period of time the inventor discovered that extreme micro-fining of crystal grains is observed in the material which is subjected to said transformation super-plastic phenomena, improve the mechanical properties of the soft steel prior to the treatment. On the basis of this discovery, the present invention has been worked out.

According to one feature of the present invention, there is provided a method for providing a toughening treatment for metallic material, characterized in that the metallic material is subjected to a transformation super-plastic treatment by applying a mechanical load to said material while placing the same under a triangularwave temperature cycle passing over a transformation point.

Above-mentioned and other features and objects of this invention will become more apparent by reference to the following detailed description in connection to its preferred embodiments.

DETAILED DESCRIPTION OF THE PRESENTLY PREFERRED EMBODIMENTS

The essence of the present invention exists in the utilization of transformation super-plastic phenomena of metallic materials. Therefore, in order to practice the method according to the present invention, heating means and cooling means for providing a triangular-wave temperature cycle as well as means for applying a mechanical load to the metallic materials are necessary. For the heating means, for instance, high frequency induction heating means or direct heating means by passing a current through a subject are suitable. For the cooling means, for example, blowing means for pressurized air are suitable, and for the means for applying a mechanical load any means which can fixedly secure one end of a body of metallic material and which can apply a shearing stress to the other end thereof are adaptable. For example, the base frame of the conventional turning lathe or any equivalent means could be used satisfactorily. The shearing stress could be selected approximately in the range of 1/10 - 1/20 of the yielding point (the durable stress) depending upon the kinds of the metallic materials.

In this way, a shearing stress is applied to metallic material while subjecting the same to a triangular-wave temperature cycle which should pass over the transformation point of the metallic material to carry out a transformation super-plastic treatment. Then extreme micro-fining of crystal grains will occur, and simultaneously therewith equalization of a metallurgical structure will proceed. As a result, sure improvements in the properties of the material as much as about 50% in strength and as much as about 20% in toughness, can be obtained. The effects of the treatment are not limited thereto, but also an associated effect of improvements in an anti-corrosion property is obtained owing to micro-fining of the crystal grains.

With regard to treatment time, according to the present invention it is shortened a great deal, compared with the prior art in such manner that a treatment time of only 30 seconds is sufficient, and accordingly, the production cost can be greatly reduced. Of course, the method according to this invention is applicable not only to steel but also to other metals and alloys, and so it is effective for improvements in strength and toughness of various parts of machine structures.

Now description will be made of one preferred embodiment in which experiments were conducted with respect to soft steel. A test piece of soft steel (SS41) was mounted on a base frame of a turning lathe so that one end is fixedly secured and a shearing stress may be applied by twisting the other end.

Subsequently, a shearing stress was applied to this test piece, while subjecting the test piece to a triangular-wave temperature cycle as specified in (a) or (b) below.

a. In case that only an $Ac_1$ transformation point (a transformation point at 723° C) is utilized, the upper limit is set at 850° C and the lower limit is set at 600° C.

b. In case that both the $Ac_1$ transformation point and an $Ac_3$ transformation point (a transformation point at 850° C) are utilized, the upper limit is set at 950° C and the lower limit is set at 600° C.

Selecting the period of one cycle at about 20 seconds, heating and cooling were repeated for about 3 cycles and the shearing stress was selected to be equal to or lower than 3 kg/mm².

Comparing the strength and toughness between those prior to the treatment and those after the treatment, the following table was obtained:

| | Prior to Treatment | After Treatment |
|---|---|---|
| Upper Yielding Point (kg/mm²) | 25.63 | 58.16 |
| Maximum Tensile Strength (kg/mm²) | 43.08 | 70.71 |
| Elongation (%) | 24.18 | 25.12 |
| Contraction (%) | 56.20 | 69.40 |
| Intrinsic Breaking Stress (kg/mm²) | 102.50 | 135.70 |

In the above, there has been shown a preferred embodiment in connection to a soft steel. What follows is a discussion of use of the method of the invention upon other materials than soft steel.

Regarding 18-8 stainless steel, when a transformation point (1100° C) was utilized and three periods of temperature cycles (20 seconds/cycle) having an upper limit of 1150° C and a lower limit of 1050° C were applied to the test piece while variably selecting the shearing stress at 1, 2 and 3 kg/mm², experimental results as shown in the following table were obtained.

| | Prior to Treatment | After Treatment | | |
|---|---|---|---|---|
| Applied Stress (kg/mm²) | — | 1.0 | 2.0 | 3.0 |
| Tensile Strength (kg/mm²) | 61.28 | 65.21 | 66.93 | 70.14 |
| Intrinsic Breaking Stress (kg/mm²) | 173.41 | 184.34 | 183.31 | 193.83 |
| Elongation (%) | 64.5 | 66.5 | 65.0 | 64.5 |
| Contraction (%) | 73.83 | 77.40 | 75.45 | 75.60 |

In the above-described embodiments, the upper and lower limits of the temperature range in the temperature cycle were selected at ±120° C with respect to the transformation point (soft steel) and at ±50° C with respect to the transformation point (18-8 stainless steel), respectively, and the frequency of the temperature cycle was selected at 3 cycles/minute. The reasons why such specific values were selected, are because the variation of the transformation point caused by the change of the heating and cooling speeds as well as the time period required between the commencement and termination of the transformation were taken into consideration. Upon practicing the present invention, the conditions for the temperature cycle passing through the transformation point up and down so as to generate super-plastic phenomena such as, for example, a temperature range and a frequency, can be selected at appropriate values depending upon the properties and shape of the material to be treated. The stress applied to the metallic material could be selected at about 1/10 to 1/20 of the yielding point (a maximum durable stress) of the metallic material.

With respect to other metals and alloys, numberless embodiments of the invention could be practiced. For instance, if the method according to the present invention is applied to duralumin having a tensile strength of about 30 kg/mm² similarly to the aforementioned embodiments, then the material can be improved in tensile strength up to a super duralumin class having a tensile strength of about 40 kg/mm² or further up to an extra super duralumin class having a tensile strength of about 50 kg/mm². Still further, if the method according to the present invention should be applied to the latter two materials, then the super duralumin would be improved in quality up to the extra super duralmin and the extra super duralmin would be improved in quality up to a material having a still higher tensile strength.

In addition, if the method according to the present invention is applied to high tensile steel of the 50 kg/mm² class, then it will be improved in quality up to that of refined high tensile steel of 80 kg/mm² class and furthermore it will be still improved up to that of material of 100 kg/mm² class.

As will be obvious from the above description, the essence of the present invention exists in utilization of the phenomena of super-plasticity of metallic materials, and according to the present invention, the strength and toughness of the metallic material can be improved within an extremely short treatment time within which no conventional method can be completed. Therefore, the advantages which are given to the metallurgical industry by the present invention are remarkably great.

While I have described above the principles of my invention in connection with specific embodiments, it is to be clearly understood that this description is made only by way of example and not as a limitation to the scope of my invention as set forth in the accompanying claims.

What is claimed is:

1. A method for providing a toughening treatment for a piece of steel which has at least one transformation point, that is a limiting temperature at which a change in phase occurs, by making use of transformation super-plastic phenomena, comprising: simultaneously a. applying a shearing stress to the piece of steel, and b. cyclicly heating for a half cycle and cooling for a half cycle the piece of steel, and in so doing, observing the following constraints:

1. the applied shearing stress has a value in the range of about 1/20th to about 1/10th of the yield point of said steel;
2. each half-cycle during which the steel is heated, it is raised to a temperature that is above said transformation point, and each half-cycle during which the steel is cooled, it is lowered to a temperature that is below said transformation point;
3. the steel is subjected to at least three of these heating and cooling cycles, and
4. ach such cycle has a period of about 20 seconds.

2. The method of claim 1, wherein the transformation point is its $AC_1$ transformation point at 723° C; and the applied shearing stress has a maximum value of 3 kg/mm².

3. The method of claim 1, wherein:

in the heating half cycles, the metallic material is heated to an upper limit of 850° C, and in the cooling half cycles, the metallic material is cooled to a lower limit of 600° C.

4. The method of claim 3, wherein the heating is accomplished by high frequency induction.

5. The method of claim 3, wherein heating is accomplished by passing an electric current through the steel.

6. The method of claim 4, wherein said cooling is undertaken by blowing air upon the steel.

7. The method of claim 3, wherein cooling is accomplished by blowing air upon the steel.

8. The method of claim 3, wherein the steel is SS41 soft steel.

9. The method of claim 1, wherein said steel is 18-8 stainless steel.

10. A method for providing a toughening treatment for a piece of metallic material which has at least one transformation point, that is a limiting temperature at which a change in phase occurs, by making use of transformation super-plastic phenomena, consisting essentially of simultaneously a. applying a shearing stress to the piece of metallic material, and b. cyclicly heating for a half cycle and cooling for a half cycle the piece of metallic material, and in so doing, observing the following constraints:

1. the applied shearing stress has a value in the range of about 1/20th to about 1/10th of the yield point of said metallic material;
2. each half-cycle during which the metallic material is heated is raised to a temperature that is above the transformation point, and each half-cycle during which the metallic material is cooled, it is lowered lowered to a temperature that is below said transformation point; and
3. the material material is subjected to at least three of these heating and cooling cycles.

* * * * *